US011137710B2

(12) United States Patent
Kanzawa

(10) Patent No.: US 11,137,710 B2
(45) Date of Patent: Oct. 5, 2021

(54) IMAGE FORMING APPARATUS AND IMAGE FORMING METHOD

(71) Applicant: Oki Electric Industry Co., Ltd., Tokyo (JP)

(72) Inventor: Naoki Kanzawa, Tokyo (JP)

(73) Assignee: OKI ELECTRIC INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 16/575,509

(22) Filed: Sep. 19, 2019

(65) Prior Publication Data

US 2020/0103808 A1 Apr. 2, 2020

(30) Foreign Application Priority Data

Sep. 28, 2018 (JP) ..... JP2018-183583

(51) Int. Cl.
*B65H 5/34* (2006.01)
*G03G 15/00* (2006.01)
*B65H 5/06* (2006.01)

(52) U.S. Cl.
CPC ..... *G03G 15/652* (2013.01); *B65H 5/062* (2013.01)

(58) Field of Classification Search
CPC ..... G03G 15/20; G03G 15/652; B65H 5/34; B65H 29/68; B65H 2513/10; B65H 1/00; B65H 2511/10; B65H 2511/12
See application file for complete search history.

(56) References Cited

U.S. PATENT DOCUMENTS

2015/0210490 A1* 7/2015 Katsura ..... B65H 3/5215 271/121
2015/0217955 A1* 8/2015 Mizuno ..... B65H 5/062 271/3.17

FOREIGN PATENT DOCUMENTS

JP 63-159891 * 7/1988
JP 6-234433 * 8/1994
JP 2002120956 A 4/2002

* cited by examiner

*Primary Examiner* — Thomas A Morrison
(74) *Attorney, Agent, or Firm* — Panitch Schwarze Belisario & Nadel LLP

(57) ABSTRACT

A print medium feeding device includes a guide unit; a first conveyance unit that applies first conveyance force F1 to the print medium, a first part of the first conveyance force applying section moving at a first linear velocity V1; a second conveyance unit including a second conveyance force applying section that makes contact with the print medium and applies second conveyance force F2 to the print medium, a second part of the second conveyance force applying section moving at a second linear velocity V2; and a third conveyance unit including a third conveyance force applying section that makes contact with the print medium and applies third conveyance force F3 to the print medium, a third part of the third conveyance force applying section moving at a third linear velocity V3, wherein V2>V3>V1 and F3>F1>F2 are satisfied.

11 Claims, 9 Drawing Sheets

IMAGE FORMING APPARATUS AND IMAGE FORMING METHOD

CROSS-REFERENCE TO RELATED APPLICATION

This application claims priority under 35 U.S.C. § 119(b) to Japanese Application No. 2018-183583, filed Sep. 28, 2018, the disclosure of which is incorporated by reference herein in its entirety.

BACKGROUND OF THE INVENTION

1. Field of the Invention

The present invention relates to a print medium feeding device and an image forming apparatus including the print medium feeding device.

2. Description of the Related Art

There has been proposed a device that includes a plurality of roller pairs for applying force in a conveyance direction to a sheet as a print medium and a control device for controlling linear velocities of the plurality of roller pairs and corrects skewing (oblique feeding) of the sheet conveyed in the conveyance direction by controlling the linear velocities of the roller pairs according to the size of the sheet. See Japanese Patent Application Publication No. 2002-120956 (claims 1 and 3), for example.

However, the aforementioned conventional device has a problem in that a configuration of the device is complicated because of the need to control the linear velocities of the roller pairs.

SUMMARY OF THE INVENTION

An object of the present invention is to provide a print medium feeding device capable of correcting a direction of a print medium with a simple configuration and an image forming apparatus including the print medium feeding device.

A print medium feeding device according to an aspect of the present invention includes: a guide unit that corrects a direction of a print medium conveyed in a conveyance direction; a first conveyance unit including a first conveyance force applying section that makes contact with the print medium and applies first conveyance force in the conveyance direction to the print medium, wherein a first part of the first conveyance force applying section that makes contact with the print medium moves in the conveyance direction at a first linear velocity; a second conveyance unit including a second conveyance force applying section that makes contact with the print medium at a position downstream of the first conveyance force applying section in the conveyance direction and applies second conveyance force in the conveyance direction to the print medium, wherein a second part of the second conveyance force applying section that makes contact with the print medium moves in the conveyance direction at a second linear velocity; and a third conveyance unit including a third conveyance force applying section that makes contact with the print medium at a position downstream of the second conveyance force applying section in the conveyance direction and applies third conveyance force in the conveyance direction to the print medium, wherein a third part of the third conveyance force applying section that makes contact with the print medium moves in the conveyance direction at a third linear velocity. $V2>V3>V1$ and $F3>F1>F2$ are satisfied where V1 represents the first linear velocity, V2 represents the second linear velocity, V3 represents the third linear velocity, F1 represents the first conveyance force, F2 represents the second conveyance force, and F3 represents the third conveyance force.

An image forming apparatus according to another aspect of the present invention includes the above-described print medium feeding device.

According to the present invention, a direction of a print medium can be corrected with a simple configuration.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
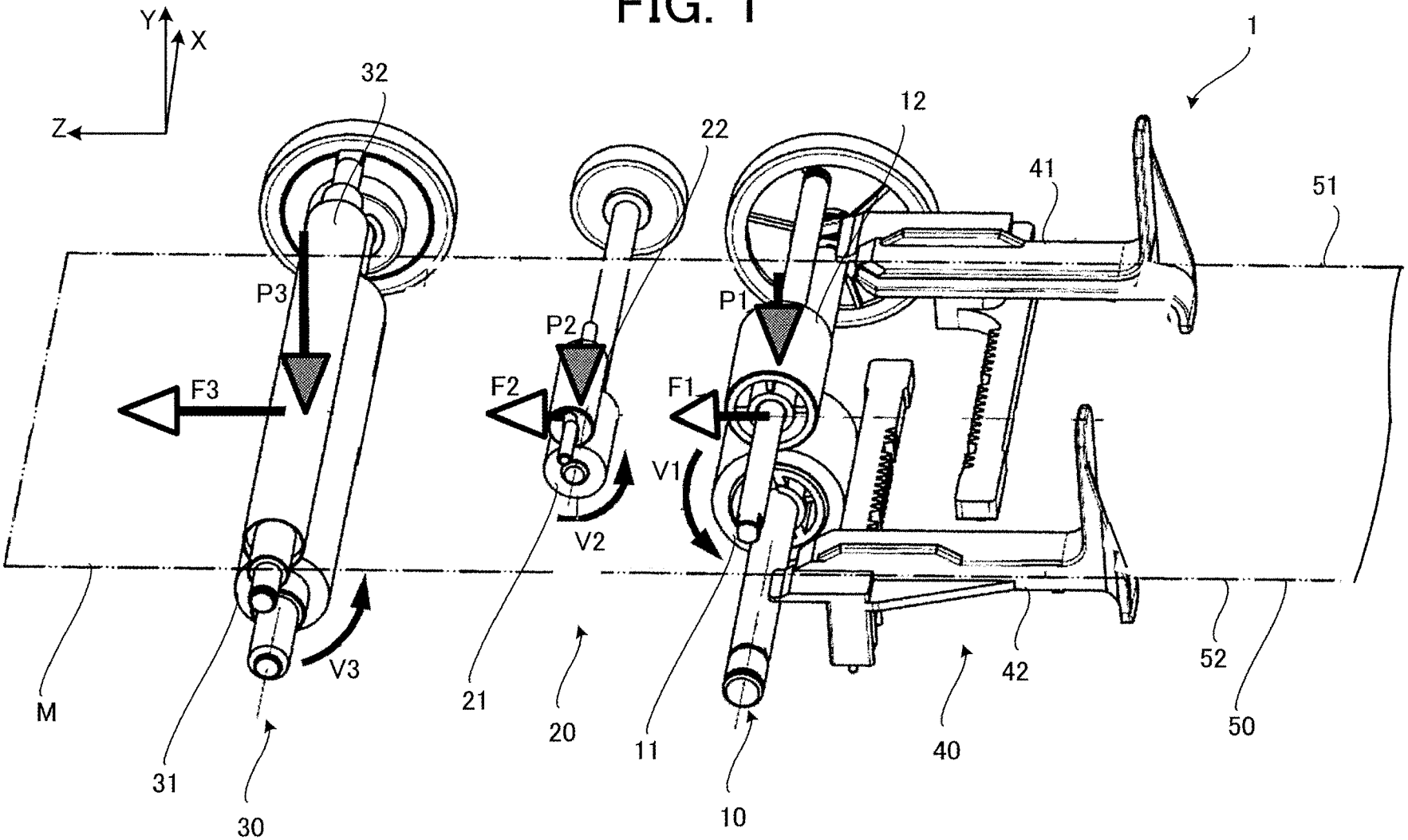
FIG. 1 is a perspective view schematically showing a configuration of a print medium feeding device according to a first embodiment of the present invention.

Print medium feeding devices and image forming apparatuses according to embodiments of the present invention will be described below with reference to drawings. The following embodiments are just examples and a variety of modifications are possible within the scope of the present invention.

Coordinate axes of an XYZ orthogonal coordinate system are shown in the drawings. An X axis is a coordinate axis parallel to a width direction of a print medium conveyed by the print medium feeding device. A Z axis is a coordinate axis extending in a conveyance direction of the print medium conveyed by the print medium feeding device. A Y axis is a coordinate axis in a direction orthogonal to the X axis and the Z axis.

(1) First Embodiment (1-1) Configuration of First Embodiment

Figure 2:
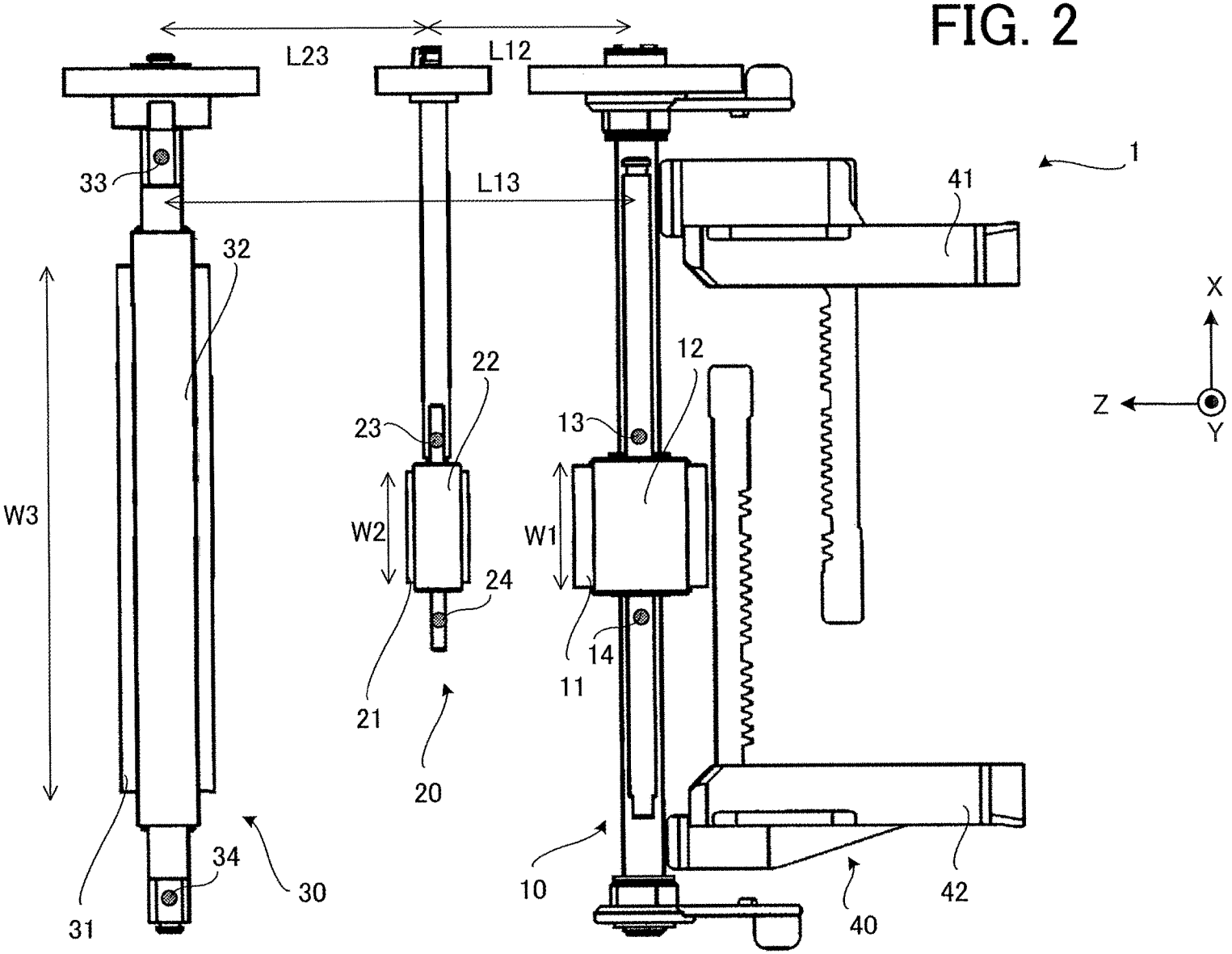
FIG. 2 is a plan view schematically showing the configuration of the print medium feeding device according to the first embodiment.
Figure 3:
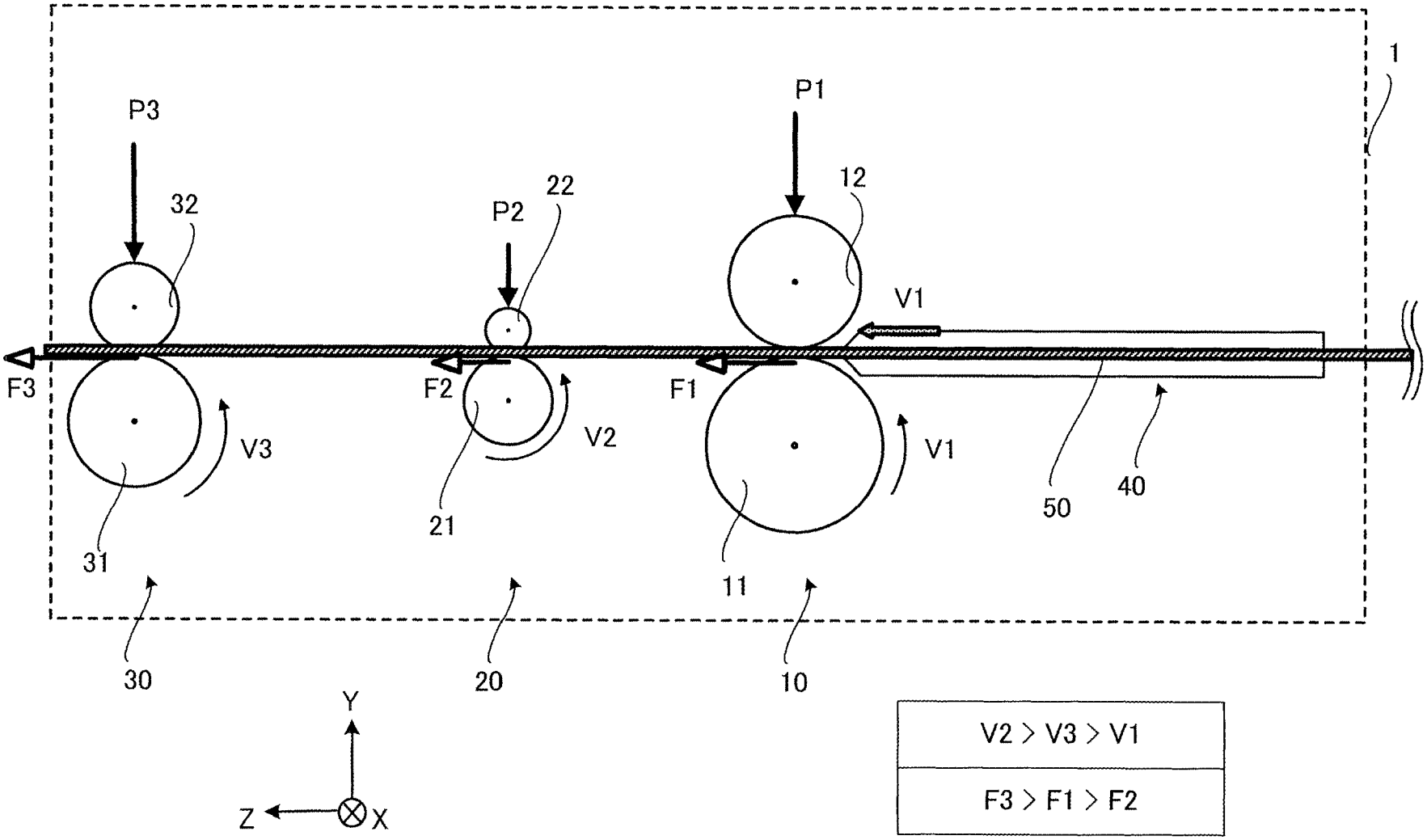
FIG. 3 is a cross-sectional view schematically showing the configuration of the print medium feeding device according to the first embodiment.

FIG. 1 is a perspective view schematically showing a configuration of a print medium feeding device 1 according to a first embodiment. FIG. 2 is a plan view schematically showing the configuration of the print medium feeding device 1. FIG. 3 is a cross-sectional view schematically showing the configuration of the print medium feeding device 1. The print medium feeding device 1 is a device that supplies a print medium M by conveying the print medium M in the conveyance direction. The print medium M is, for example, a continuous sheet 50 shown in FIG. 1. The print medium M may also be a cut sheet 60 shown in FIG. 6 which will be explained later. The print medium M may be formed of a material other than paper as long as the print medium M is a sheet-like member.

The print medium feeding device 1 includes a guide unit 40, a first conveyance unit 10, a second conveyance unit 20 and a third conveyance unit 30. The guide unit 40, the first conveyance unit 10, the second conveyance unit 20 and the third conveyance unit 30 are arranged in this order from an upstream side towards a downstream side in the conveyance direction of the print medium (i.e., +Z axis direction).

In the print medium feeding device 1, the guide unit 40 includes side guides 41 and 42. The first conveyance unit 10 includes an upstream roller pair. The second conveyance unit 20 includes an intermediate roller pair. The third conveyance unit 30 includes a downstream roller pair.

The guide unit 40 corrects (i.e., rectifies) skewing and meandering of the print medium M (i.e., the direction of the print medium) conveyed in the conveyance direction. Each side guide 41, 42 has a guide surface parallel to the Z axis direction. Edge parts 51 and 52 as sides of the print medium M extending in the conveyance direction of the print medium M are made to contact the guide surfaces of the side guides 41 and 42, by which the skewing and the meandering are corrected.

The first conveyance unit 10 includes a first conveyance force applying section that makes contact with the print medium M and applies first conveyance force F1 in the conveyance direction to the print medium M. A first part of the first conveyance force applying section that makes contact with the print medium M moves in the conveyance direction at a first linear velocity V1. In a case where the first conveyance unit 10 is the upstream roller pair, the first conveyance force applying section is a drive roller 11 as a first driving member having a first part to make contact with the print medium M. The drive roller 11 is also referred to as a first drive roller. The outer circumference of the drive roller 11 rotates at the first linear velocity V1. Rotary driving force of the drive roller 11 is generated by a driving force generating section such as a motor (not shown) and transmitted to the drive roller 11 by a driving force transmission mechanism such as gears (not shown). The first conveyance force applying section may also be a different member applying the first conveyance force F1 to the print medium M. For example, the first conveyance force applying section can be a drive belt having an outer surface that makes contact with the print medium M.

The first conveyance unit 10 includes a pressure roller 12 as a first pressing section that presses the print medium M against the drive roller 11 at first pressing force P1. In this case, the drive roller 11 and the pressure roller 12 constitute the upstream roller pair sandwiching the print medium M and conveying the print medium M in the conveyance direction. The pressure roller 12 is also referred to as a first pressure roller. The first conveyance unit 10 may include a different member for applying the first pressing force P1 to the print medium M instead of the pressure roller 12. The structure of the first conveyance unit 10 is not limited to the illustrated example; different structure such as vertically inverted structure can be employed, for example.

The second conveyance unit 20 includes a second conveyance force applying section that makes contact with the print medium M and applies second conveyance force F2 in the conveyance direction to the print medium M. A second part of the second conveyance force applying section that makes contact with the print medium M moves in the conveyance direction at a second linear velocity V2. In a case where the second conveyance unit 20 is the intermediate roller pair, the second conveyance force applying section is a drive roller 21 as a second driving member having a second part to make contact with the print medium M. The drive roller 21 is also referred to as a second drive roller. The outer circumference of the drive roller 21 rotates at the second linear velocity V2. Rotary driving force of the drive roller 21 is generated by a driving force generating section such as a motor (not shown) and transmitted to the drive roller 21 by a driving force transmission mechanism such as gears (not shown). The second conveyance force applying section may also be a different member applying the second conveyance force F2 to the print medium M. For example, the second conveyance force applying section can be a drive belt having an outer surface that makes contact with the print medium M.

The second conveyance unit 20 includes a pressure roller 22 as a second pressing section that presses the print medium M against the drive roller 2*i* at second pressing force P2. The pressure roller 22 is also referred to as a second pressure roller. In this case, the drive roller 21 and the pressure roller 22 constitute the intermediate roller pair sandwiching the print medium M and conveying the print medium M in the conveyance direction. The second conveyance unit 20 may include a different member for applying the second pressing force P2 to the print medium M instead of the pressure roller 22. The structure of the second conveyance unit 20 is not limited to the illustrated example; different structure such as vertically inverted structure can be employed, for example.

The third conveyance unit 30 includes a third conveyance force applying section that makes contact with the print medium M and applies third conveyance force F3 in the conveyance direction to the print medium M. A third part of the third conveyance force applying section that makes contact with the print medium M moves in the conveyance direction at a third linear velocity V3. In a case where the third conveyance unit 30 is the downstream roller pair, the third conveyance force applying section is a drive roller 31 as a third driving member having a third part to make contact with the print medium M. The drive roller 31 is also referred to as a third drive roller. The outer circumference of the drive roller 31 rotates at the third linear velocity V3. Rotary driving force of the drive roller 31 is generated by a driving force generating section such as a motor (not shown) and transmitted to the drive roller 31 by a driving force transmission mechanism such as gears (not shown). The third conveyance force applying section may also be a different member applying the third conveyance force F3 to the print medium M. For example, the third conveyance force applying section can be a drive belt having an outer surface that makes contact with the print medium M.

The first pressing force P1 is applied to the pressure roller 12 by first urging members such as springs (13 and 14 in FIG. 2). The second pressing force P2 is applied to the pressure roller 22 by second urging members such as springs (23 and 24 in FIG. 2). Third pressing force P3 is applied to a pressure roller 32 by third urging members such as springs (33 and 34 in FIG. 2).

The third conveyance unit 30 includes the pressure roller 32 as a third pressing section that presses the print medium M against the drive roller 31 at the third pressing force P3. The pressure roller 32 is also referred to as a third pressure roller. In this case, the drive roller 31 and the pressure roller 32 constitute the downstream roller pair sandwiching the print medium M and conveying the print medium M in the conveyance direction. The third conveyance unit 30 may include a different member for applying the third pressing force P3 to the print medium M instead of the pressure roller 32. The structure of the third conveyance unit 30 is not limited to the illustrated example; different structure such as vertically inverted structure can be employed, for example.

The print medium feeding device 1 is configured to satisfy the following conditions (1) and (2):

$$V2>V3>V1 \quad (1)$$

$$F3>F1>F2 \quad (2)$$

Here, V1 represents the first linear velocity, V2 represents the second linear velocity, V3 represents the third linear velocity, F1 represents the first conveyance force, F2 represents the second conveyance force, and F3 represents the third conveyance force.

A surface on the outer circumference of each drive roller 11, 21, 31 that makes contact with the print medium M is formed of a member having a friction coefficient μ (e.g., rubber member), for example. The first conveyance force F1, the second conveyance force F2 and the third conveyance force F3 applied to the print medium M by the drive rollers 11, 21 and 31 are respectively determined by the product of the friction coefficient μ and the first pressing force P1, the product of the friction coefficient μ and the second pressing force P2, and the product of the friction coefficient μ and the third pressing force P3. Thus, when the surfaces on the outer circumferences of the drive rollers 11, 21 and 31 that make contact with the print medium M are of the same material and hardness as each other, F1=μ·P1, F2=μ·P2 and F3=μ·P3 hold.

Accordingly, when the surfaces of the drive rollers 11, 21 and 31 that make contact with the print medium M are of the same material and hardness as each other, the condition (2) can be represented by the following condition (3):

$$P3>P1>P2 \quad (3)$$

Here, P1 represents the first pressing force, P2 represents the second pressing force, and P3 represents the third pressing force.

The friction coefficient of the pressure roller 22, 32 is desired to be smaller than the friction coefficient of the drive roller 21, 31. The friction coefficient of the pressure roller 22 may be any value with which the third conveyance force F3 can be applied. The pressure rollers 12, 22 and 32 are made of plastic, for example.

In FIG. 2, L12 represents a distance between the drive roller 11 and the drive roller 21, that is, a path length as the length of a conveyance path of the print medium M between the drive roller 11 and the drive roller 21. L12 is 30.3 mm, for example.

In FIG. 2, L23 represents a distance between the drive roller 21 and the drive roller 31, that is, a path length of the print medium M between the drive roller 21 and the drive roller 31. L23 is 40.7 mm, for example.

In FIG. 2, L13 represents a distance between the drive roller 11 and the drive roller 31, that is, a path length of the print medium between the drive roller 11 and the drive roller 31. L13 is the sum of L12 and L23. L13 is 71.0 mm, for example.

Further, in FIG. 2, W3 represents a third length in a width direction (i.e., X axis direction) of a sandwiching region of the downstream roller pair constituting the third conveyance unit 30. W2 represents a second length in the width direction of the sandwiching region of the intermediate roller pair constituting the second conveyance unit 20. W1 represents a first length in the width direction of the sandwiching region of the upstream roller pair constituting the first conveyance unit 10. In the first embodiment, W3>W2 and W3>W1 hold.

The print medium M that can be conveyed by the print medium feeding device 1 is a print medium whose medium length as the length of the print medium M in the conveyance direction is longer than or equal to L23. The print medium M that can be conveyed by the print medium feeding device 1 may be either a cut sheet (60 in FIG. 6 which will be explained later) or a continuous sheet (50 in FIG. 1). The continuous sheet 50 may be either roll paper or fanfold paper. The print medium M fed from the print medium feeding device 1 is supplied to an image forming apparatus, for example. The print medium M fed from the print medium feeding device 1 is supplied to the image forming apparatus in a condition in which the skewing and the meandering have been corrected. The image forming apparatus will be described later in a second embodiment.

(1-2) Operation when Medium Length of Print Medium M is Longer than or Equal to L13

Figure 4A:
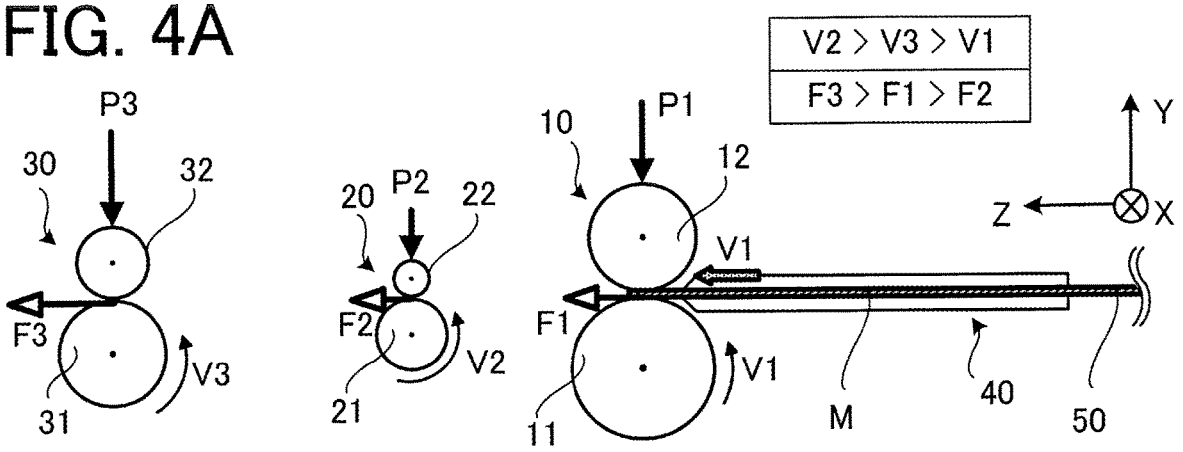
FIGS. 4A to 4C are diagrams showing operation of the print medium feeding device according to the first embodiment (i.e., operation when a print medium is a continuous sheet or a cut sheet whose medium length is long)
Figure 4B:
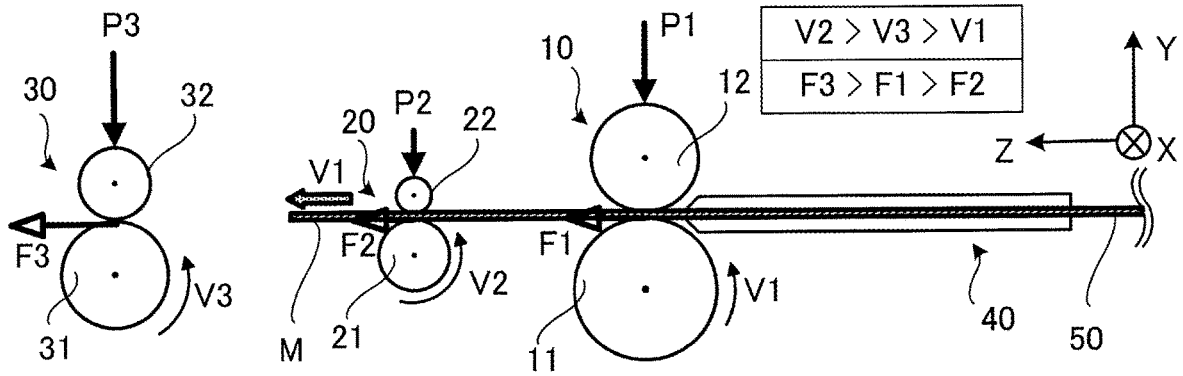
Figure 4C:
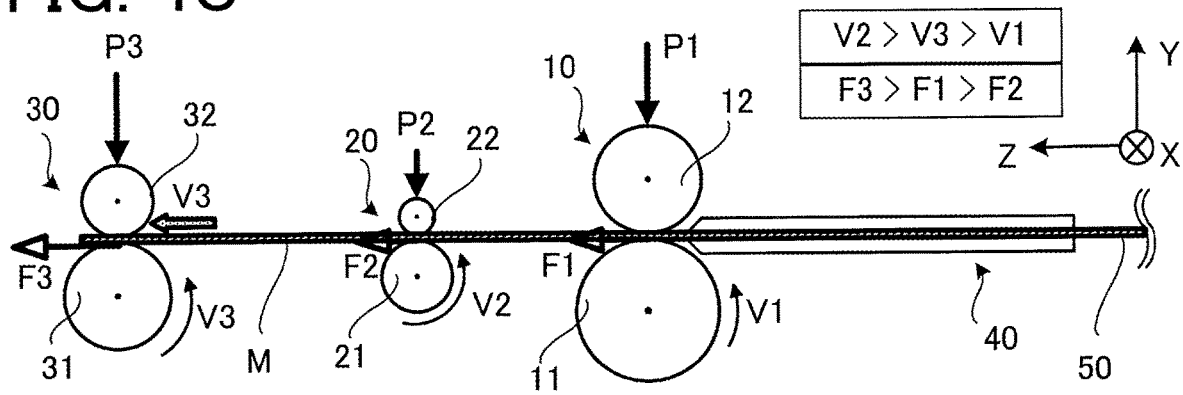

FIGS. 4A to 4C are diagrams showing operation of the print medium feeding device 1 (i.e., operation when the print medium M is a continuous sheet 50 or a cut sheet having a medium length longer than or equal to L13).

FIG. 4A shows a state in which the upstream roller pair of the first conveyance unit 10 has sandwiched a front end of the print medium M and started conveying the print medium M in the conveyance direction. Since the print medium M is conveyed by a non-illustrated medium supply mechanism while having the edge parts 51 and 52 as the sides extending in the conveyance direction contact the side guides 41 and 42, the print medium M reaching the first conveyance unit 10 is conveyed in the conveyance direction in the condition in which the skewing and the meandering have been corrected. When the upstream roller pair of the first conveyance unit 10 sandwiches the front end of the print medium M and conveys the print medium M in the conveyance direction, the first conveyance force F1 is applied from the drive roller 11 of the first conveyance unit 10 to the print medium M at the first linear velocity V1. Accordingly, the print medium M is conveyed in the conveyance direction at a velocity equal to the first linear velocity V1.

FIG. 4B shows a state in which the upstream roller pair of the first conveyance unit 10 and the intermediate roller pair of the second conveyance unit 20 are sandwiching the print medium M and conveying the print medium M in the conveyance direction. Since the print medium M is conveyed while having the edge parts 51 and 52 extending in the conveyance direction contact the side guides 41 and 42, the print medium M reaching the second conveyance unit 20 is conveyed in the conveyance direction in the condition in which the skewing and the meandering have been corrected. When the first conveyance unit 10 and the second conveyance unit 20 convey the print medium M in the conveyance direction, the first conveyance force F1 is applied from the drive roller 11 of the first conveyance unit 10 to the print medium M at the first linear velocity V1 and the second conveyance force F2 is applied from the drive roller 21 of the second conveyance unit 20 to the print medium M at the second linear velocity V2. Here, F1>F2 holds while V2>V1 holds. Accordingly, the print medium M is conveyed by the first conveyance unit 10 having strong conveyance force and slippage occurs between the second conveyance unit 20 and the print medium M. Thus, in the state of FIG. 4B, the print medium M is conveyed in the conveyance direction at the velocity equal to the first linear velocity V1.

FIG. 4C shows a state in which the upstream roller pair of the first conveyance unit 10, the intermediate roller pair of the second conveyance unit 20 and the downstream roller pair of the third conveyance unit 30 are sandwiching the print medium M and conveying the print medium M in the conveyance direction. The print medium M reaching the third conveyance unit 30 is conveyed in the conveyance direction in the condition in which the skewing and the meandering have been corrected. At that time, the first conveyance force F1 is applied from the drive roller 11 of the first conveyance unit 10 to the print medium M at the first linear velocity V1, the second conveyance force F2 is applied from the drive roller 21 of the second conveyance unit 20 to the print medium M at the second linear velocity V2, and the third conveyance force F3 is applied from the drive roller 31 of the third conveyance unit 30 to the print medium M at the third linear velocity V3. Here, F3>F1>F2 holds while V2>V3>V1 holds. Accordingly, the movement of print medium M is governed by the third conveyance unit 30 having the strongest conveyance force and slippage occurs between the second conveyance unit 20 and the print medium M and between the first conveyance unit 10 and the print medium M. Thus, in the state of FIG. 4C, the print medium M whose skewing and meandering have been corrected by the guide unit 40 is conveyed in the conveyance direction at a velocity equal to the third linear velocity V3.

(1-3) Operation when Medium Length of Print Medium M is Longer than or Equal to L23 and Shorter than L13

Figure 6:
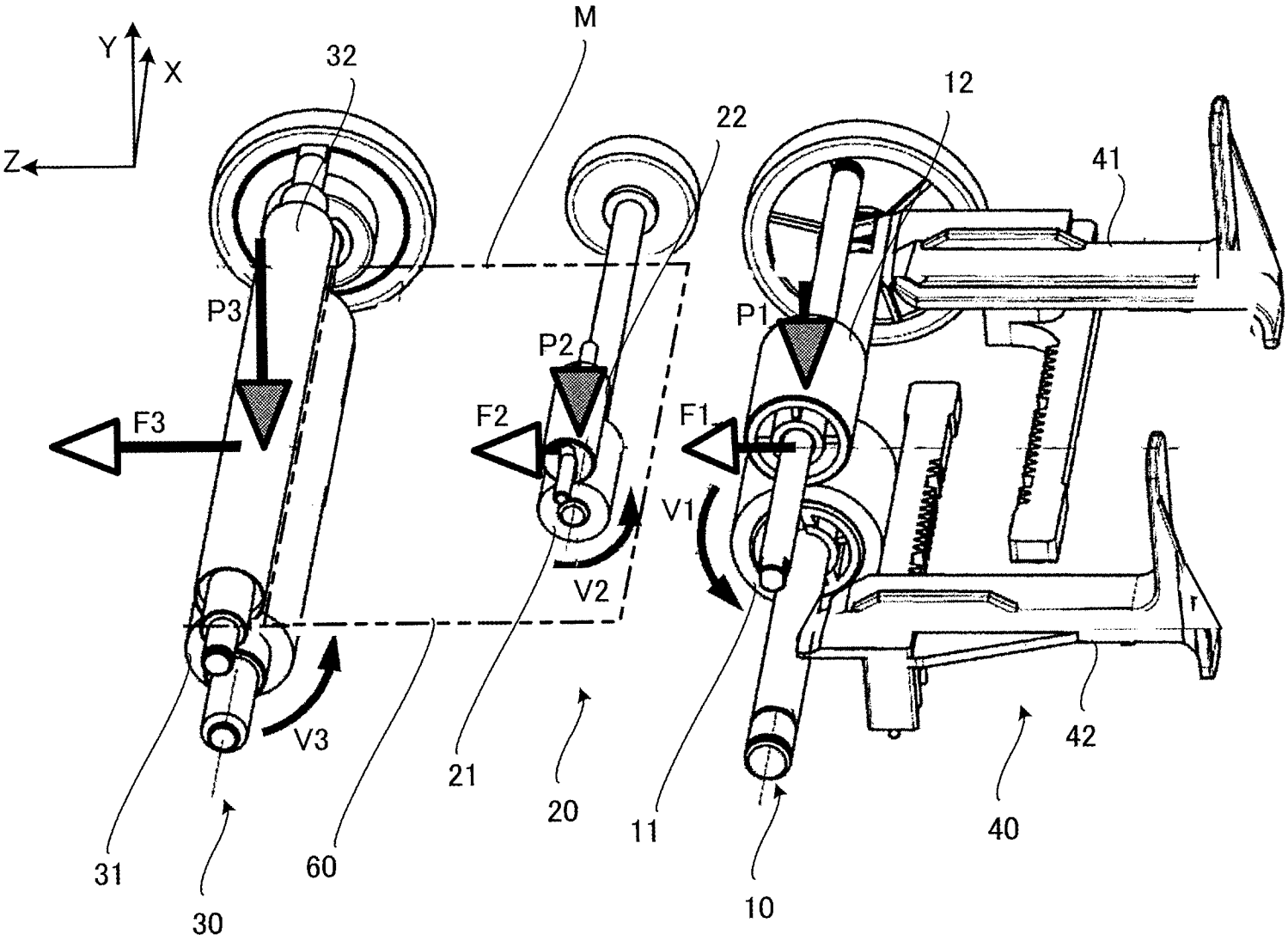
FIG. 6 is a perspective view showing a state of FIG. 5D.
Figure 7:
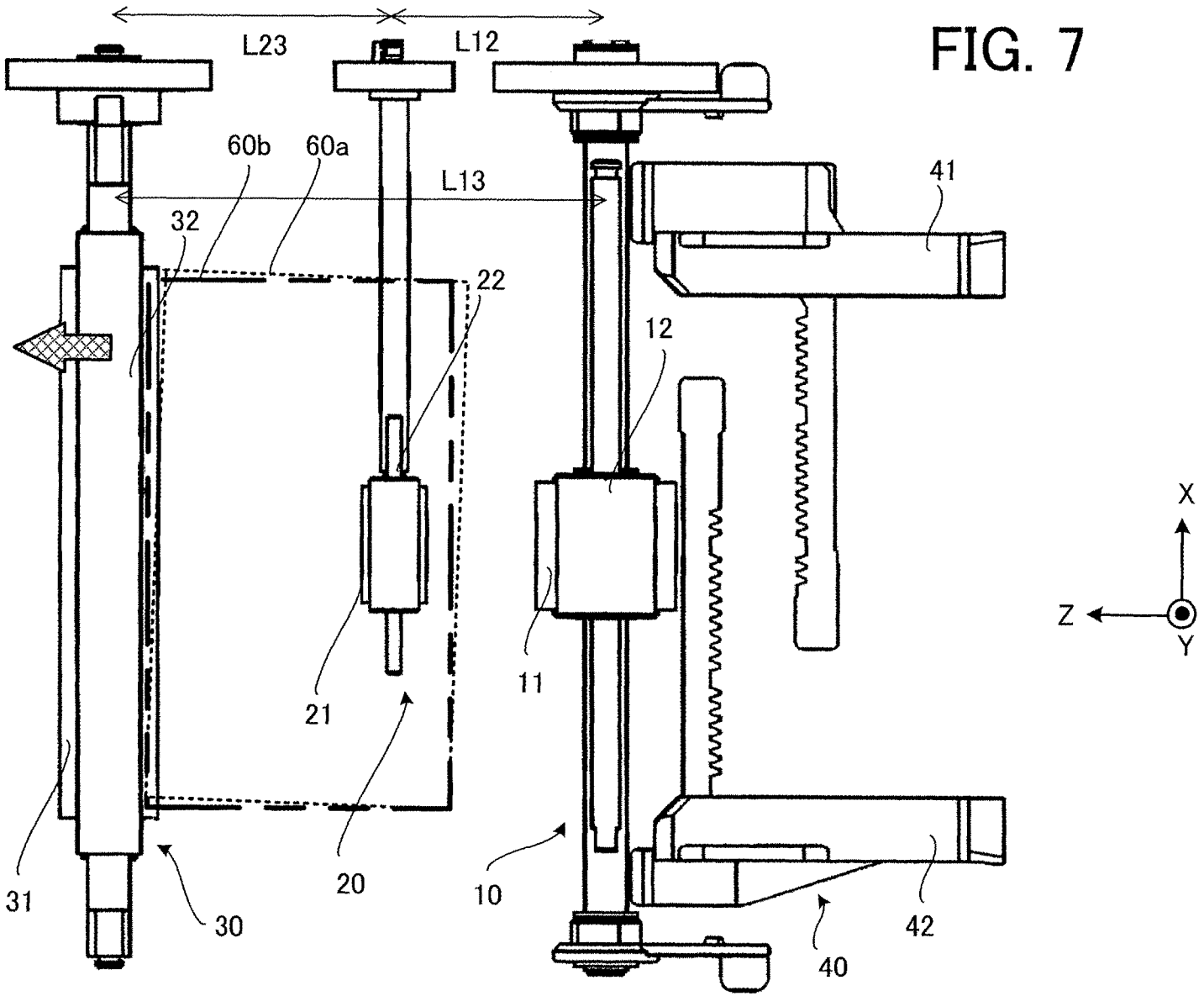
FIG. 7 is a plan view showing the state of FIG. 5D.

FIGS. 5A to 5E are diagrams showing operation of the print medium feeding device 1 (i.e., operation when the print medium M is a cut sheet 60 whose medium length is longer than or equal to L23 and shorter than L13. FIG. 6 is a perspective view schematically showing the state of FIG. 5D. FIG. 7 is a plan view schematically showing the state of FIG. 5D.

Figure 5A:
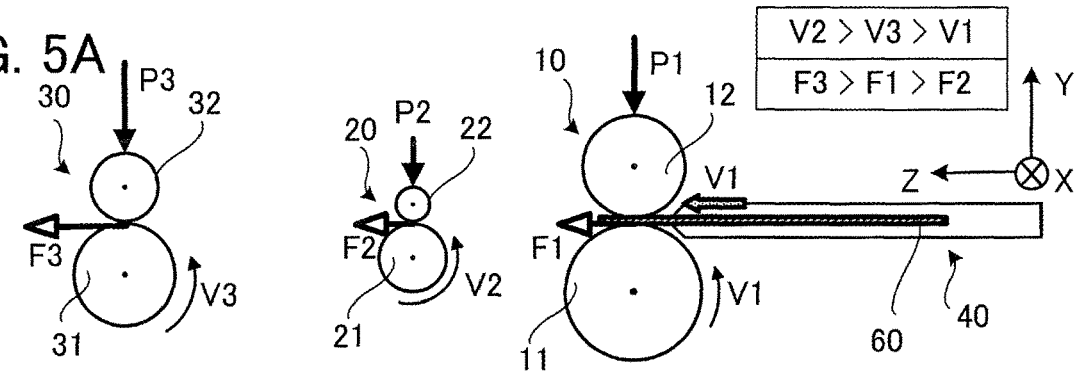
FIGS. 5A to 5E are diagrams showing operation of the print medium feeding device according to the first embodiment (i.e., operation when the print medium is a cut sheet whose medium length is short)

FIG. 5A shows a state in which the upstream roller pair of the first conveyance unit 10 is sandwiching the front end of the print medium M and starting to convey the print medium M in the conveyance direction. The print medium M is conveyed while having the edge parts as the sides extending in the conveyance direction contact the side guides 41 and 42 of the guide unit 40. However, the edge parts of the print medium M extending in the conveyance direction do not need to contact the side guides 41 and 42. When the first conveyance unit 10 has started to convey the print medium M in the conveyance direction, the first conveyance force F1 is applied from the drive roller 11 of the first conveyance unit 10 to the print medium M at the first linear velocity V1. Accordingly, the print medium M is conveyed in the conveyance direction at the velocity equal to the first linear velocity V1.

Figure 5B:
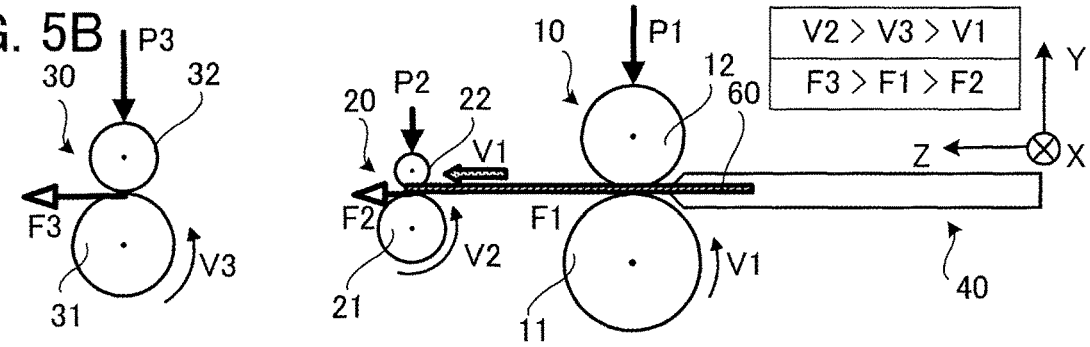

FIG. 5B shows a state in which the upstream roller pair of the first conveyance unit 10 and the intermediate roller pair of the second conveyance unit 20 are sandwiching the print medium M and conveying the print medium M in the conveyance direction. At that time, the first conveyance force F1 is applied from the drive roller 11 of the first conveyance unit 10 to the print medium M at the first linear velocity V1 and the second conveyance force F2 is applied from the drive roller 21 of the second conveyance unit 20 to the print medium M at the second linear velocity V2. Here, F1>F2 holds while V2>V1 holds. Accordingly, the movement of the print medium M is governed by the first conveyance unit 10 having strong conveyance force and slippage occurs between the second conveyance unit 20 and the print medium M. Thus, in the state of FIG. 5B, the print medium M is conveyed in the conveyance direction at the velocity equal to the first linear velocity V1.

Figure 5C:
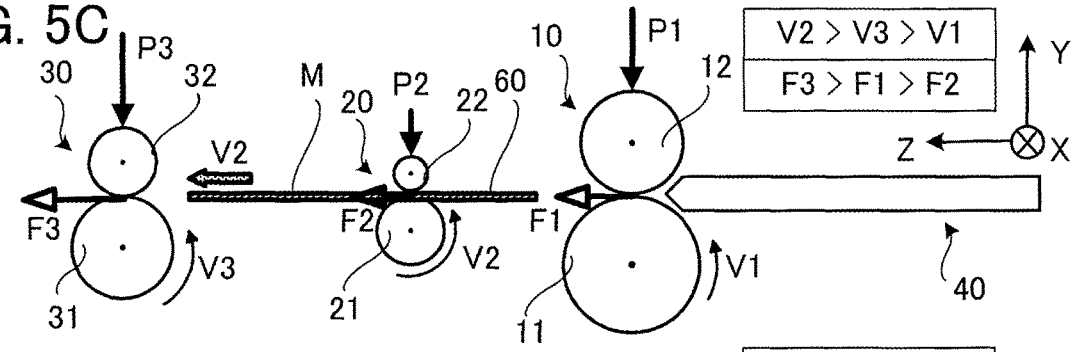

FIG. 5C shows a state in which the intermediate roller pair of the second conveyance unit 20 is sandwiching the print medium M and conveying the print medium M in the conveyance direction. At that time, the second conveyance force F2 is applied from the drive roller 21 of the second conveyance unit 20 to the print medium M at the second linear velocity V2. Accordingly, the print medium M is conveyed in the conveyance direction at a velocity equal to the second linear velocity V2.

Figure 5D:
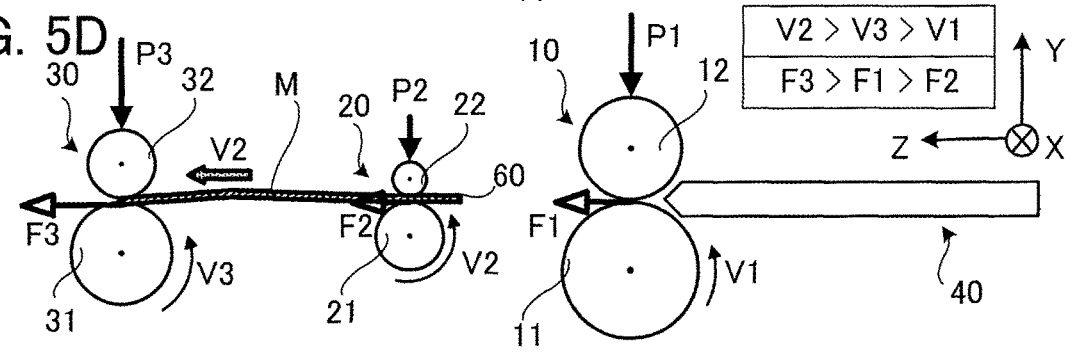

FIG. 5D, FIG. 6 and FIG. 7 show a state in which the intermediate roller pair of the second conveyance unit 20 sandwiches the print medium M and the front end of the print medium M is butted against the downstream roller pair of the third conveyance unit 30. At that time, the second conveyance force F2 is applied from the drive roller 21 of the second conveyance unit 20 to the print medium M at the second linear velocity V2 and the third conveyance force F3 starts being applied from the drive roller 31 of the third conveyance unit 30 to the print medium M at the third linear velocity V3. However, bending (or slack) occurs to the print medium M since V2>V3 holds.

When the front end of the print medium M is butted against the third conveyance unit 30 in a skewed or meandering condition as indicated by a reference character 60*a* in FIG. 7, the print medium M rotates around the second conveyance unit 20 and assumes the condition in which the skewing and the meandering have been corrected as indicated by a reference character 60*b*.

Figure 5E:
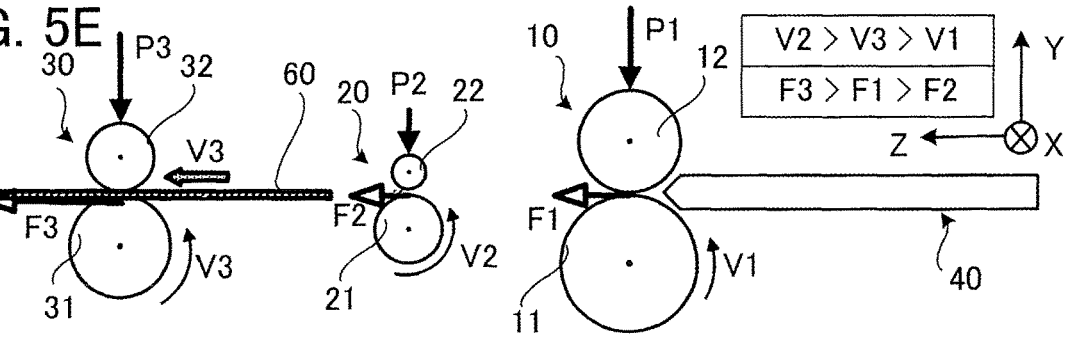

FIG. 5E shows a state in which the downstream roller pair of the third conveyance unit 30 is sandwiching the print medium M and conveying the print medium M in the conveyance direction. At that time, the third conveyance force F3 is applied from the drive roller 31 of the third conveyance unit 30 to the print medium M at the third linear velocity V3. Accordingly, in the state of FIG. 5E, the print medium M is conveyed in the conveyance direction at the velocity equal to the third linear velocity V3. Thus, in the state of FIG. 5E, the print medium M whose skewing and meandering have been corrected by the state of FIG. 5D is conveyed in the conveyance direction at the velocity equal to the third linear velocity V3.

(1-4) Effect of First Embodiment

As described above, according to the print medium feeding device 1 according to the first embodiment, the skewing and the meandering of the print medium M as a cut sheet whose medium length is longer than or equal to L13 or a continuous sheet are corrected by a side registration method with the side guides 41 and 42 of the guide unit 40. Further, linear velocity and conveyance force preventing slack in the print medium M are applied to the print medium M even after the print medium M passes through the guide unit 40, and thus the print medium M can be conveyed stably.

The skewing and the meandering of the print medium M whose medium length is longer than or equal to L23 and shorter than L13 is corrected by front end butting registration by use of linear velocity difference between the second conveyance unit 20 and the third conveyance unit 30.

As above, according to the print medium feeding device 1 according to the first embodiment, the skewing and the meandering of the print medium M whose medium length is longer than or equal to L13 (e.g., continuous sheet 50) and the print medium M whose medium length is shorter than L13 (e.g., cut sheet 60) can be corrected without the need of changing the first to third linear velocities V1, V2 and V3 and the first to third conveyance forces F1, F2 and F3 of the first to third conveyance units 10, 20 and 30. Accordingly, the configuration of the device can be simplified.

(1-5) First Modification of First Embodiment

Figure 8:
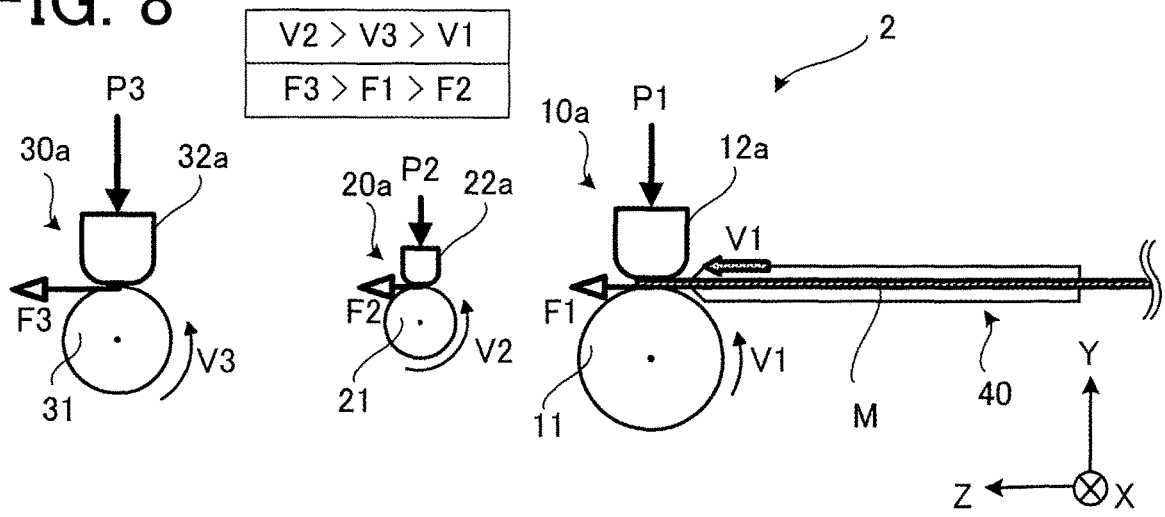
FIG. 8 is a cross-sectional view schematically showing a configuration of a print medium feeding device according to a first modification of the first embodiment.

FIG. 8 is a cross-sectional view schematically showing a configuration of a print medium feeding device 2 according to a first modification of the first embodiment. In FIG. 8, components that are the same as or correspond to components shown in FIG. 3 are assigned the same reference characters as those shown in FIG. 3. The print medium feeding device 2 differs from the print medium feeding device 1 in the structure of a first conveyance unit 10*a*, a second conveyance unit 20*a* and a third conveyance unit 30*a*.

In the print medium feeding device 2, the first conveyance unit 10*a* includes the drive roller 11 as the first conveyance force applying section and a pressing member 12*a* as the first pressing section for pressing the print medium against the drive roller 11. In the print medium feeding device 2, the second conveyance unit 20*a* includes the drive roller 21 as the second conveyance force applying section and a pressing member 22*a* as the second pressing section for pressing the print medium against the drive roller 21. In the print medium feeding device 2, the third conveyance unit 30*a* includes the drive roller 31 as the third conveyance force applying section and a pressing member 32*a* as the third pressing section for pressing the print medium against the drive roller 31. The friction coefficient of the pressing member 12*a*, 22*a*, 32*a* is desired to be smaller than the friction coefficient of the drive roller 11, 21, 31.

The print medium M moves in the conveyance direction between the drive roller 11 and the pressing member 12*a*, between the drive roller 21 and the pressing member 22*a*, and between the drive roller 31 and the pressing member 32*a* similarly to the operations described with reference to FIGS. 4A to 4C and FIGS. 5A to 5E. The print medium feeding device 2 has an advantage in that the configuration can be more simplified than the print medium feeding device 1.

Except for the above-described features, the print medium feeding device 2 is the same as the print medium feeding device 1.

(1-6) Second Modification of First Embodiment

Figure 9:
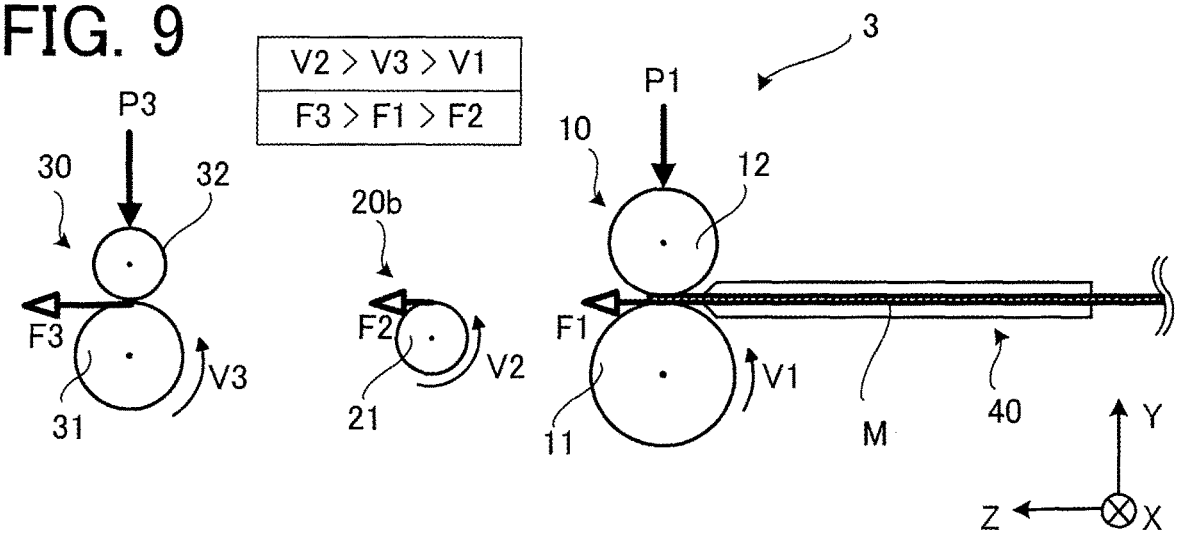
FIG. 9 is a cross-sectional view schematically showing a configuration of a print medium feeding device according to a second modification of the first embodiment.

FIG. 9 is a cross-sectional view schematically showing a configuration of a print medium feeding device 3 according to a second modification of the first embodiment. In FIG. 9, components that are the same as or correspond to components shown in FIG. 3 are assigned the same reference characters as those shown in FIG. 3. The print medium feeding device 3 differs from the print medium feeding device 1 in the structure of a second conveyance unit 20*b*.

In the print medium feeding device 3, the second conveyance unit 20*b* includes the drive roller 21 as the second conveyance force applying section and does not include a pressing member.

The print medium M moves in the conveyance direction between the drive roller 11 and the pressure roller 12, over the drive roller 21, and between the drive roller 31 and the pressure roller 32. The print medium feeding device 3 has an advantage in that the configuration can be more simplified than the print medium feeding device 1.

Except for the above-described features, the print medium feeding device 3 is the same as the print medium feeding device 1. It is also possible to apply the configuration of the second modification to the first modification.

(1-7) Third Modification of First Embodiment

Figure 10:
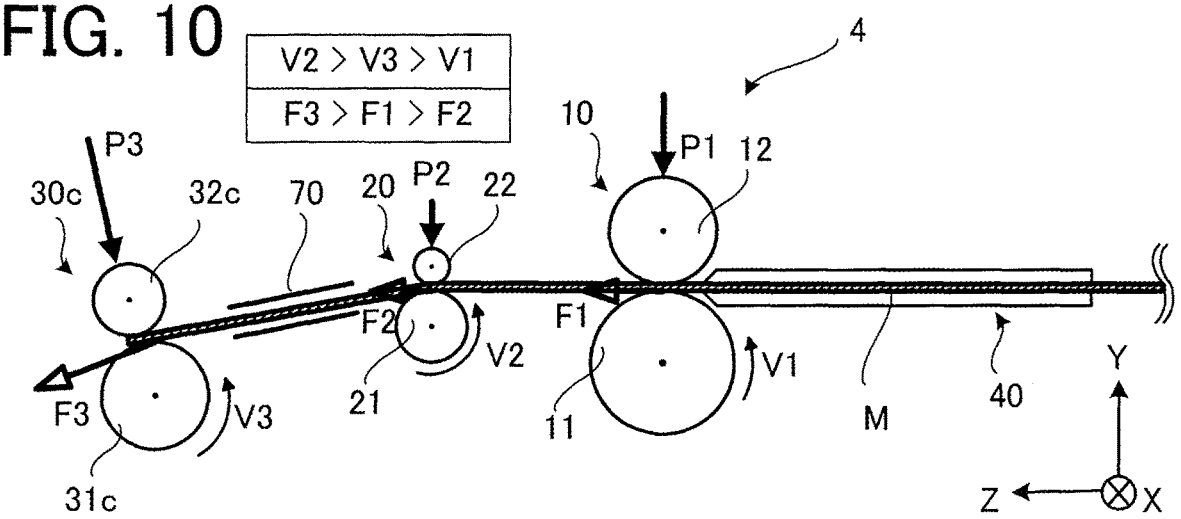
FIG. 10 is a cross-sectional view schematically showing a configuration of a print medium feeding device according to a third modification of the first embodiment.

FIG. 10 is a cross-sectional view schematically showing a configuration of a print medium feeding device 4 according to a third modification of the first embodiment. In FIG. 10, components that are the same as or correspond to components shown in FIG. 3 are assigned the same reference characters as those shown in FIG. 3. The print medium feeding device 4 differs from the print medium feeding device 1 in including a guide member 70 that directs the conveyance path of the print medium towards a third conveyance unit 30*c*.

In the print medium feeding device 4, the third conveyance unit 30*c* includes a drive roller 31*c* as the third conveyance force applying section and a pressure roller 32*c* as the third pressing section for pressing the print medium against the drive roller 31*c*.

The print medium M moves in the conveyance direction between the drive roller 11 and the pressure roller 12, between the drive roller 21 and the pressure roller 22, through the guide member 70, and between the drive roller 31*c* and the pressure roller 32*c*. The print medium feeding device 4 has an advantage in that a length of the device in the Z axis direction can be shortened compared with the print medium feeding device 1.

Except for the above-described features, the print medium feeding device 4 is the same as the print medium feeding device 1. It is also possible to apply the configuration of the third modification to the first and second modifications.

(2) Second Embodiment

Figure 11:
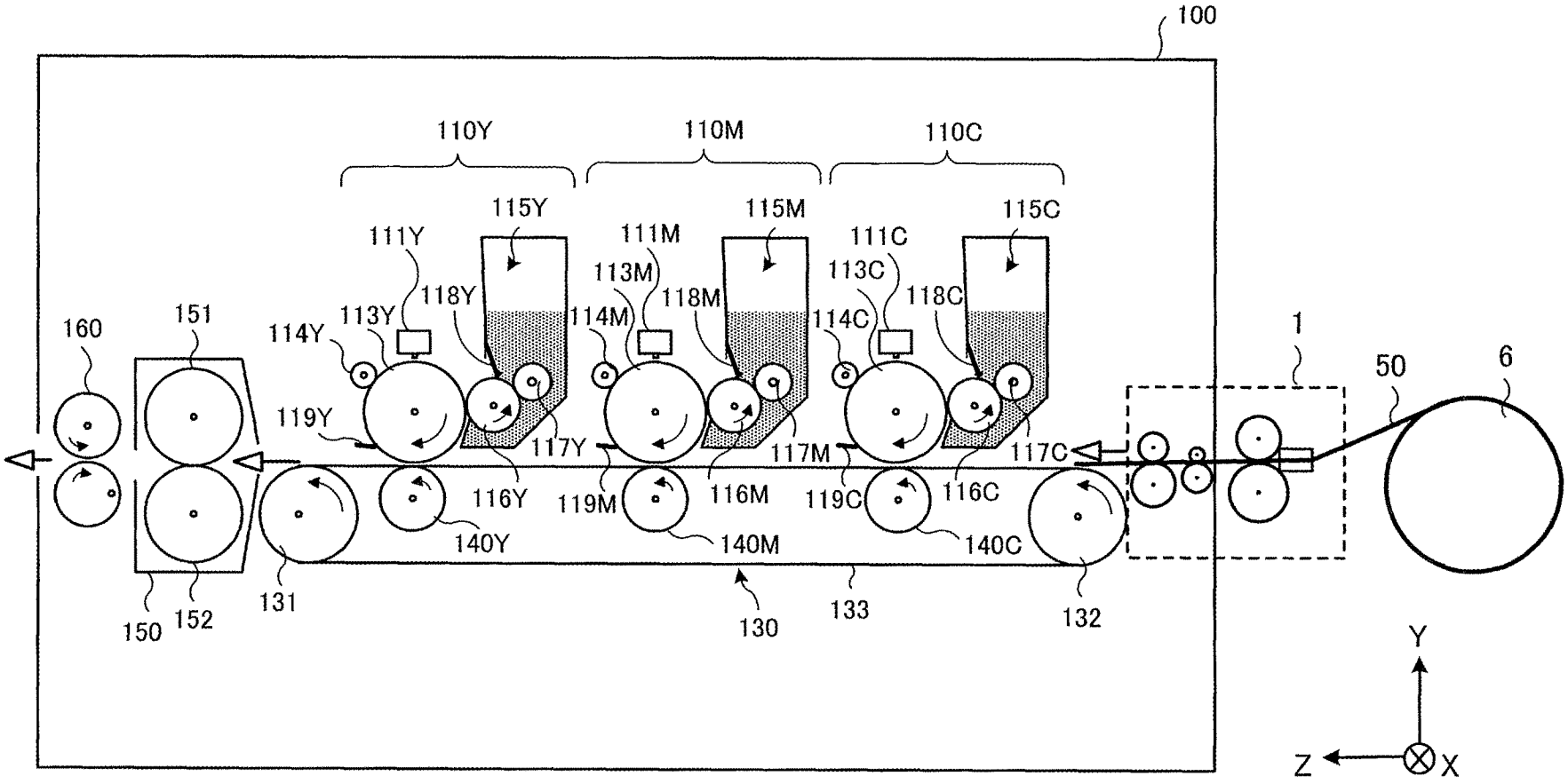
FIG. 11 is a cross-sectional view schematically showing a configuration of an image forming apparatus according to a second embodiment of the present invention.

FIG. 11 is a cross-sectional view schematically showing a configuration of an image forming apparatus 100 according to a second embodiment. The image forming apparatus 100 is, for example, a color printer using an electrophotographic process. As shown in FIG. 11, the image forming apparatus 100 is equipped with the print medium feeding device 1 according to the first embodiment. The print medium feeding device 1 supplies the print medium to a medium conveyance unit 130 of the image forming apparatus 100. FIG. 11 shows a state in which a continuous sheet 50 is drawn out from a roll sheet 6 rotatably supported by a holding section and is supplied to the print medium feeding device 1. Incidentally, the print medium supplied to the print medium feeding device 1 may also be a cut sheet. Further, the image forming apparatus 100 may be equipped with one of the print medium feeding devices 2 to 4 having different structure instead of the print medium feeding device 1.

As shown in FIG. 11, principal components of the image forming apparatus 100 include image forming units (i.e., process units) 110C, 110M and 110Y that form toner images (i.e., developing agent images) on the print medium such as a sheet by the electrophotographic process, the print medium feeding device 1 as a medium supply unit that supplies the print medium to the image forming units 110C, 110M and 110Y, a conveyance unit 130 that conveys the print medium, transfer rollers 140C, 140M and 140Y as transfer units respectively arranged corresponding to the image forming units 110C, 110M and 110Y, a fixation unit 150 that fixes the toner images transferred onto the print medium, and a roller pair 160 as a medium ejection unit that ejects the print medium after passing through the fixation unit 150 to the outside of a housing of the image forming apparatus 100. The number of image forming units included in the image forming apparatus 100 may also be two or less or four or more. Further, the image forming apparatus 100 may be an image forming apparatus employing a different printing method as long as the image forming apparatus is a device forming an image on a print medium.

The image forming units 110C, 110M and 110Y respectively form a cyan toner image, a magenta toner image and a yellow toner image on the print medium. The image forming units 110C, 110M and 110Y are arranged in this order along the medium conveyance path from the upstream side to the downstream side in the medium conveyance direction (i.e., from right to left in FIG. 11). Each of the image forming units 110C, 110M and 110Y may be provided as a detachable unit. The image forming units 110C, 110M and 110Y have basically the same structure as each other except that the colors of the toners stored in the image forming units 110C, 110M and 110Y differ from each other.

The image forming units 110C, 110M and 110Y respectively include optical print heads 111C, 111M and 111Y as exposure devices for the colors.

Each image forming unit 110C, 110M, 110Y includes a photosensitive drum 113C, 113M, 113Y as an image carrier supported rotatably, a charging roller 114C, 114M, 114Y as a charging member that uniformly charges a surface of the photosensitive drum 113C, 113M, 113Y, and a development unit 115C, 115M, 115Y that forms a toner image corresponding to an electrostatic latent image by supplying a toner to the surface of the photosensitive drum 113C, 113M, 113Y after the electrostatic latent image is formed on the surface of the photosensitive drum 113C, 113M, 113Y by exposure by the optical print head 111C, 111M, 111Y.

Each development unit 115C, 115M, 115Y includes a toner storage part as a developing agent storage part forming a developing agent storage space for storing the toner, a development roller 116C, 116M, 116Y as a developing agent carrier that supplies the toner to the surface of the photosensitive drum 113C, 113M, 113Y, a supply roller 117C, 117M, 117Y that supplies the toner stored in the toner storage part to the development roller 116C, 116M, 116Y, and a development blade 118C, 118M, 118Y as a toner regulation member that regulates the thickness of a toner layer on the surface of the development roller 116C, 116M, 116Y.

The exposure by each optical print head 111C, 111M, 111Y is performed on the uniformly charged surface of the photosensitive drum 113C, 113M, 113Y according to image data for the printing. Each optical print head 111C, 111M, 111Y includes a light-emitting device array having light-emitting thyristors or light-emitting diodes arranged in an axis line direction of the photosensitive drum 113C, 113M, 113Y as a plurality of light-emitting devices.

As shown in FIG. 11, the conveyance unit 130 includes a conveyance belt (i.e., transfer belt) 133 that electrostatically attracts and conveys the print medium, a drive roller 131 that is rotated by a drive section and drives the conveyance belt 133, and a tension roller (i.e., driven roller) 132 that forms a pair with the drive roller 131 and stretches the conveyance belt 133.

As shown in FIG. 11, the transfer rollers 140C, 140M and 140Y are arranged to respectively face the photosensitive drums 113C, 113M and 113Y of the image forming units 110C, 110M and 110Y across the conveyance belt 133. The toner images formed on the surfaces of the photosensitive drums 113C, 113M and 113Y of the image forming units 110C, 110M and 110Y are successively transferred by the transfer rollers 140C, 140M and 140Y onto an upper surface of the print medium conveyed along the medium conveyance path in directions of arrows. Each image forming unit 110C, 110M, 110Y includes a cleaning device 119C, 119M, 119Y that removes the toner remaining on the photosensitive drum 113C, 113M, 113Y after the toner image developed on the photosensitive drum 113C, 113M, 113Y is transferred to the print medium.

The fixation unit 150 includes a pair of rollers 151 and 152 pressed against each other. The roller 151 is a heat roller including a built-in heater, while the roller 152 is a pressure roller pressed towards the roller 151. The print medium having unfixed toner images thereon passes between the pair of rollers 151 and 152 of the fixation unit 150. At that time, the unfixed toner images are heated and pressed and thereby fixed on the print medium.

At the time of printing, the print medium is sent to the conveyance belt 133 through the print medium feeding device 1 and then conveyed to the image forming units 110C, 110M and 110Y according to the travel of the conveyance belt 133. The print medium to be sent to the conveyance belt 133 is sent to the conveyance belt 133 in the condition in which the skewing and the meandering have been corrected by the print medium feeding device 1. In each image forming unit 110C, 110M, 110Y, the surface of the photosensitive drum 113C, 113M, 113Y is charged by the charging roller 114C, 114M, 114Y and exposed by the optical print head 111C, 111M, 111Y, by which the electrostatic latent image is formed. To the electrostatic latent image, the toner that has been formed into a thin layer on the development roller 116C, 116M, 116Y adheres electrostatically, by which the toner image of each color is formed. The toner image of each color is transferred by the transfer roller 140C, 140M, 140Y to the print medium and a color toner image is formed on the print medium. The toner remaining on the photosensitive drum 113C, 113M, 113Y after the transfer is removed by the cleaning device 119C, 119M, 119Y. The print medium on which the color toner image has been formed is sent to the fixation unit 150. In the fixation unit 150, the color toner image is fixed on the print medium and a color image is formed. The print medium with the color image formed thereon is ejected by the roller pair 160 to the outside of the device.

As described above, the image forming apparatus 100 according to the second embodiment is equipped with one of the print medium feeding devices 1 to 4 according to the first embodiment, and thus an image can be formed on a print medium whose skewing and meandering have been corrected.

Further, the operation of the print medium feeding device does not need to be changed according to the medium length of the print medium. Therefore, the configuration of the image forming apparatus 100 can be simplified.

Incidentally, the structure of the image forming apparatus is not limited to the example shown in FIG. 11. The image forming apparatus can be a device that forms a toner image on a print medium via an intermediate transfer belt unit. Further, the image forming apparatus can be a device employing a different printing method such as the inkjet method.

The invention being thus described, it will be obvious that the same may be varied in many ways. Such variations are not to be regarded as a departure from the spirit and scope of the invention, and all such modifications as would be obvious to one skilled in the art are intended to be included within the scope of following claims.

What is claimed is:

1. A print medium feeding device for feeding a print medium to an image forming unit that forms an image on the print medium, the device comprising:

a guide unit that corrects a direction of a print medium conveyed in a conveyance direction;

a first conveyance unit including a first conveyance force applying section that makes contact with the print medium and applies first conveyance force in the conveyance direction to the print medium, wherein a first part of the first conveyance force applying section that makes contact with the print medium moves in the conveyance direction at a first linear velocity;

a second conveyance unit including a second conveyance force applying section that makes contact with the print medium at a position downstream of the first conveyance force applying section in the conveyance direction and applies second conveyance force in the conveyance direction to the print medium, wherein a second part of the second conveyance force applying section that makes contact with the print medium moves in the conveyance direction at a second linear velocity; and a third conveyance unit including a third conveyance force applying section that makes contact with the print medium at a position downstream of the second conveyance force applying section in the conveyance direction and applies third conveyance force in the conveyance direction to the print medium, wherein a third part of the third conveyance force applying section that makes contact with the print medium moves in the conveyance direction at a third linear velocity, wherein the guide unit, the first conveyance unit, the second conveyance unit, and the third conveyance unit are arranged upstream in the conveyance direction from the image forming unit, wherein $V2>V3>V1$ and $F3>F1>F2$ are satisfied where V1 represents the first linear velocity, V2 represents the second linear velocity, V3 represents the third linear velocity, F1 represents the first conveyance force, F2 represents the second conveyance force, and F3 represents the third conveyance force, the first to third linear velocities being velocities when the print medium is being conveyed.

2. The print medium feeding device according to claim 1, wherein the first conveyance force applying section is a first driving member having the first part to make contact with the print medium, the second conveyance force applying section is a second driving member having the second part to make contact with the print medium, and the third conveyance force applying section is a third driving member having the third part to make contact with the print medium.

3. The print medium feeding device according to claim 1, wherein the first conveyance force applying section is a first drive roller, the second conveyance force applying section is a second drive roller, and the third conveyance force applying section is a third drive roller.

4. The print medium feeding device according to claim 1, wherein the first conveyance unit includes a first pressing section that presses the print medium against the first conveyance force applying section at first pressing force, the second conveyance unit includes a second pressing section that presses the print medium against the second conveyance force applying section at second pressing force, and the third conveyance unit includes a third pressing section that presses the print medium against the third conveyance force applying section at third pressing force.

5. The print medium feeding device according to claim 4, wherein the first pressing section is a first pressure roller, the second pressing section is a second pressure roller, and the third pressing section is a third pressure roller.

6. The print medium feeding device according to claim 4, wherein $P3>P1>P2$ is satisfied where P1 represents the first pressing force, P2 represents the second pressing force, and P3 represents the third pressing force.

7. The print medium feeding device according to claim 1, wherein the guide unit is arranged upstream of the first conveyance unit in the conveyance direction.

8. The print medium feeding device according to claim 1, wherein the guide unit makes contact with an edge part of the print medium, the edge part extending in the conveyance direction.

9. The print medium feeding device according to claim 1, wherein a first length of a region where the first conveyance unit sandwiches the print medium in a width direction orthogonal to the conveyance direction is shorter than a third length of a region where the third conveyance unit sandwiches the print medium in the width direction, and a second length of a region where the second conveyance unit sandwiches the print medium in the width direction is shorter than the third length of the region where the third conveyance unit sandwiches the print medium in the width direction.

10. The print medium feeding device according to claim 1, wherein a cut sheet or a continuous sheet are used as the print medium.

11. An image forming apparatus comprising the print medium feeding device according to claim 1.

* * * * *